US005103876A

United States Patent [19]

Benz et al.

[11] Patent Number: 5,103,876

[45] Date of Patent: Apr. 14, 1992

[54] ROTATABLE THREAD CATCHER FOR WEFT METERING DEVICE

[75] Inventors: Rolf Benz, Gachnang, Switzerland; John D. Griffith, Sunderland, Great Britain

[73] Assignee: Sulzer Brothers Limited, Winterthur, Switzerland

[21] Appl. No.: 661,465

[22] Filed: Feb. 26, 1991

[30] Foreign Application Priority Data

Mar. 8, 1990 [CH] Switzerland ..... 747/90

[51] Int. Cl.[5] ..... D03D 47/36

[52] U.S. Cl. ..... 139/452; 139/435.1; 139/453; 264/290.5; 242/47.01; 242/47.03

[58] Field of Search ..... 264/290.5, 290.7; 242/18 A, 25 A, 18 PW, 47.03, 47.01; 139/453, 452, 435.1

[56] References Cited

U.S. PATENT DOCUMENTS 2,674,414 4/1954 Hicks et al. ..... 242/18 A
4,102,507 7/1978 Hoffmann et al. ..... 242/18 PW
4,623,007 11/1986 Griffith ..... 139/435.1 X

FOREIGN PATENT DOCUMENTS 0031661 7/1981 European Pat. Off. .
0194396 9/1986 European Pat. Off. .
1535621 9/1969 Fed. Rep. of Germany .
2190962 2/1974 France .
0445404 2/1968 Switzerland .
WO86/00942 2/1986 World Int. Prop. O. .

*Primary Examiner*—Andrew M. Falik
*Attorney, Agent, or Firm*—Kenyon & Kenyon

[57] ABSTRACT

The metering device for metering the weft yarn of a loom comprises a metering roller which is disposed between a supply unit and a draw off unit and which, in metering operation, is wrapped around by the weft yarn and determines the weft yarn draw off speed. In the event of a weft yarn break, a new waft start is injected past the metering roller into a catching nozzle and by way of a deflector into a yarn accumulator. A brake terminates the injection step. While a draw off element applies tension to the yarn, the yarn is wrapped automatically and in a number of turns around the metering roller by being moved into a catching zone of a catcher, which is rotatable around the metering roller axis, through the agency of a relative movement between the injected weft yarn and the catcher. During one revolution of the catcher around the roller axis, the weft yarn is deposited on the metering roller in the form of a wrapping. After a number of wraps of weft yarn around the metering roller, a severing element parts off the remainder of the yarn moving towards the accumulator and the resulting new yarn tip is moved by the metering roller into a start position for the weaving cycle.

24 Claims, 8 Drawing Sheets

ROTATABLE THREAD CATCHER FOR WEFT METERING DEVICE

This invention relates to a metering device for metering a weft yarn in a loom.

As is known, various types of metering devices and weft yarn draw-off devices have been used in various kinds of looms. For example, German OS 2545476 describes a device for delivering yarn to a loom wherein the device includes a metering roller for determining a weft yarn draw-off speed as well as a weft accumulator disposed downstream of the metering roller. French Patent 2,190,962 particularly describes a metering roller located between a supply nozzle which supplies a weft yarn and an injection nozzle which picks the weft yarn into a shed of a weaving loom. In this construction, the metering roller is wrapped with a plurality of windings of the weft yarn.

Swiss Patent 445,404, European Patent Application 0194396, German OS 1,535,621 and International Application WO86/00942 (PCT/CH85/00116) also describe various types of yarn storage devices or accumulators which employ drums or drum-like structures having an axis perpendicular to the direction of weft insertion for the accumulation and subsequent picking of a yarn into a weaving machine.

With all of the various types of metering devices for metering weft yarns into a loom, it has been known that interruptions in weaving due to bobbin changing for weft yarn breakages cause unwanted losses of weaving time, particularly using metering devices such as those described in the above-noted publications.

Accordingly, it is an object of this invention to be able to automatically thread a metering device when supply bobbins are renewed or when there are weft yarn breakages and to bring a new weft yarn automatically into a programmed start position for weaving.

It is another object of the invention to be able to deliver a weft yarn to a loom in a coordinated fashion.

It is another object of the invention to provide a relatively simple metering device for the metering of a weft yarn in a loom.

Briefly, the invention provides a metering device for metering a weft yarn in a loom which employs a metering roller which is rotatably mounted on an axis for disposition adjacent and transverse to a weft yarn path between a supply unit for supplying the weft yarn and a draw-off unit for receiving the weft yarn. The roller is provided with a peripheral surface for receiving loops of a weft yarn while a rotatably mounted catcher having a catching zone is disposed radially outside this surface for selectively catching a yarn in the path and for looping the yarn about the surface. In addition, a means is provided for selectively moving one of the catcher and the yarn relative to each other in order to effect catching of the yarn in the catching zone for wrapping about the peripheral surface of the roller.

The metering device further includes an injection nozzle for receiving and directing a yarn from the supply unit along a predetermined path transverse to the axis of the roller and spaced from the peripheral surface of the roller as well as a catching nozzle in the yarn path downstream of the roller for receiving a yarn from the injection nozzle.

In one embodiment, the means for effecting the catching of the yarn in the catching zone of the catcher includes a deflector element which is rotatably mounted on a axis transverse to the yarn path and a pin which is eccentrically mounted on this element for movement into the yarn path in response to rotation of the deflector element so as to move a yarn in the path into the catching zone of the catcher.

Alternatively, the means for effecting catching of a yarn from the yarn path may be in the form of an air jet nozzle for deflecting the yarn into the catching zone of the catcher. In still another embodiment, the means may be in the form of a pivotally mounted guide which is movable between a position in the yarn path with a yarn passing therethrough and a second position to deflect the yarn into the catching zone of the catcher.

In still another embodiment, the means for effecting catching of the yarn may be constructed so as to move the catcher into the path of the yarn. Such a means may include a mounting having the catcher secured thereon coaxially of the metering roller and a further means for moving the mounting coaxially of the roller. Such a second means may include a reciprocably mounted transfer arm which is disposed coaxially of the metering roller and means on the transfer arm for selectively engaging with and disengaging from the mounting in order to permit the transfer arm to move away from the mounting after movement of catcher on the mounting into the yarn path. In this embodiment, the catcher may be in the form of an open flier hook having a plurality of bends.

The catcher may also be constructed in different manners. For example, the catcher may be integrally mounted on a peripheral edge of the roller with a catching zone disposed between the catcher and the roller edge. Alternatively, the catcher may be in the form of a pin which projects from the metering roller. For example, the pin may have a pin axis defining an angle of less than 60° with a perpendicular line from a root of the pin to the axis of rotation of the metering roller.

One advantage provided by the metering device is an increase in loom availability when particular kinds of weft yarn interruptions are cleared automatically as they arise or as instructed by a loom operator.

These and other objects and advantages of the invention will become more apparent from the following detailed description taken in conjunction with the accompanying drawings wherein:

FIG. 1 schematically illustrates a metering device in accordance with the invention disposed between a supply unit for supplying a weft yarn and a draw-off unit for receiving the weft yarn;

Figure 1:
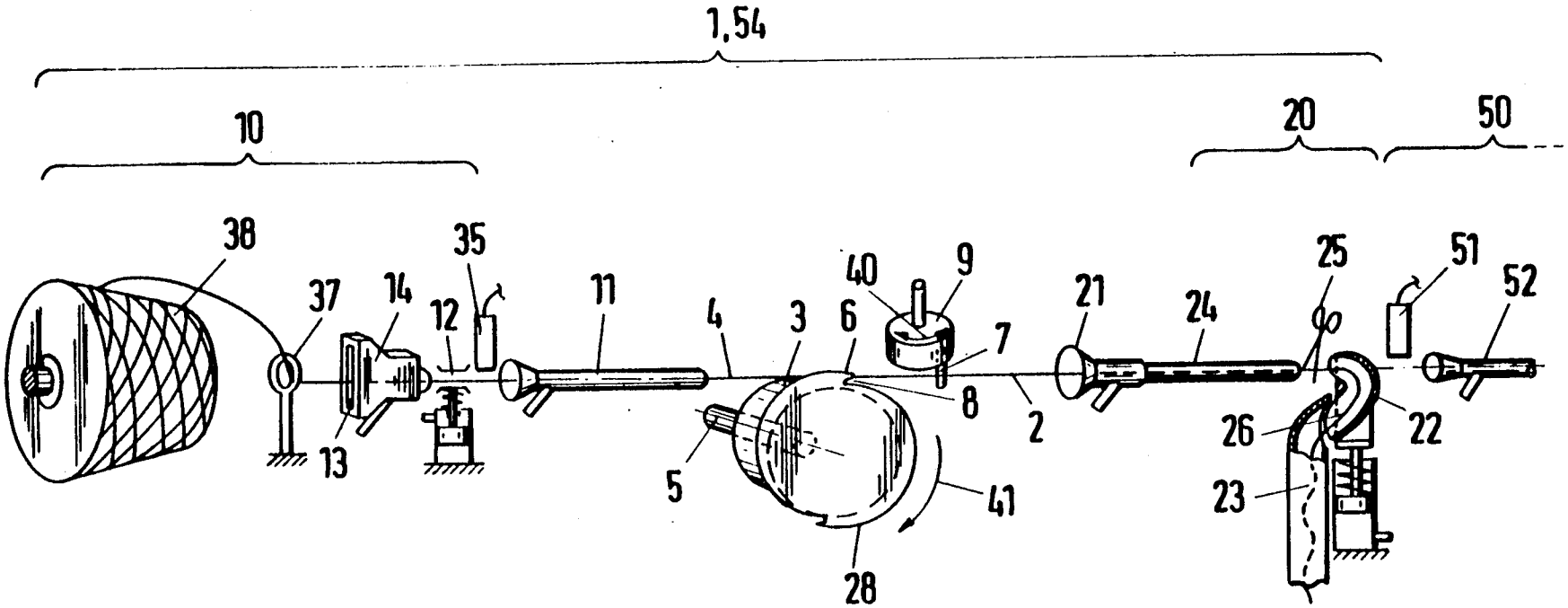
Figure 10:
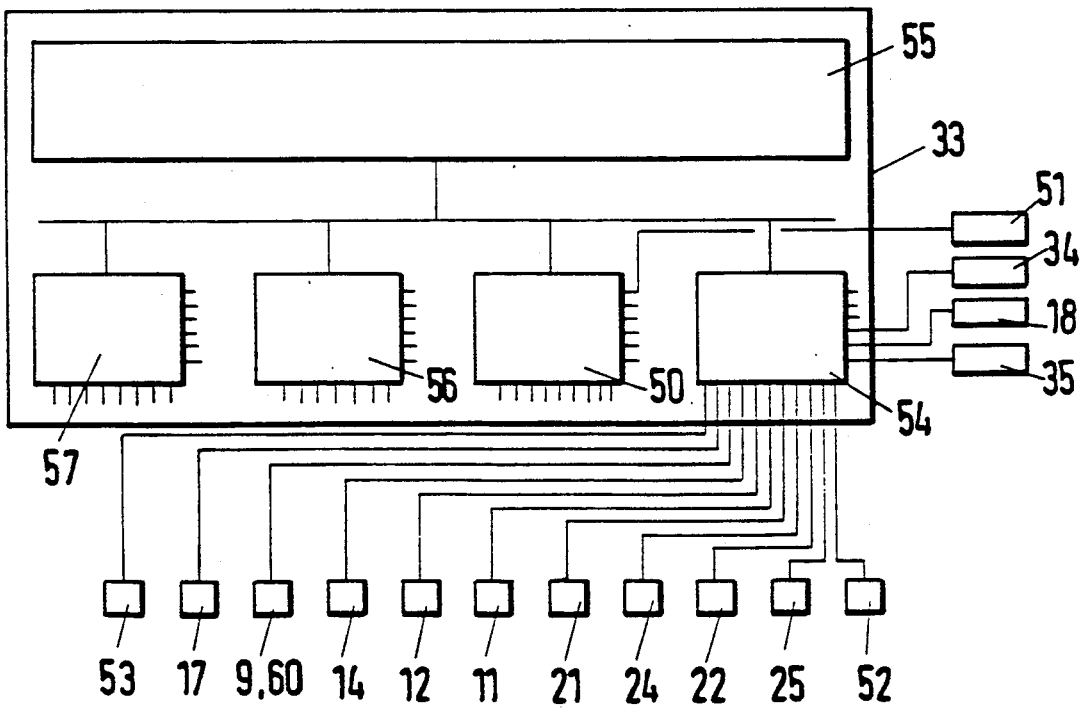
Figure 11:
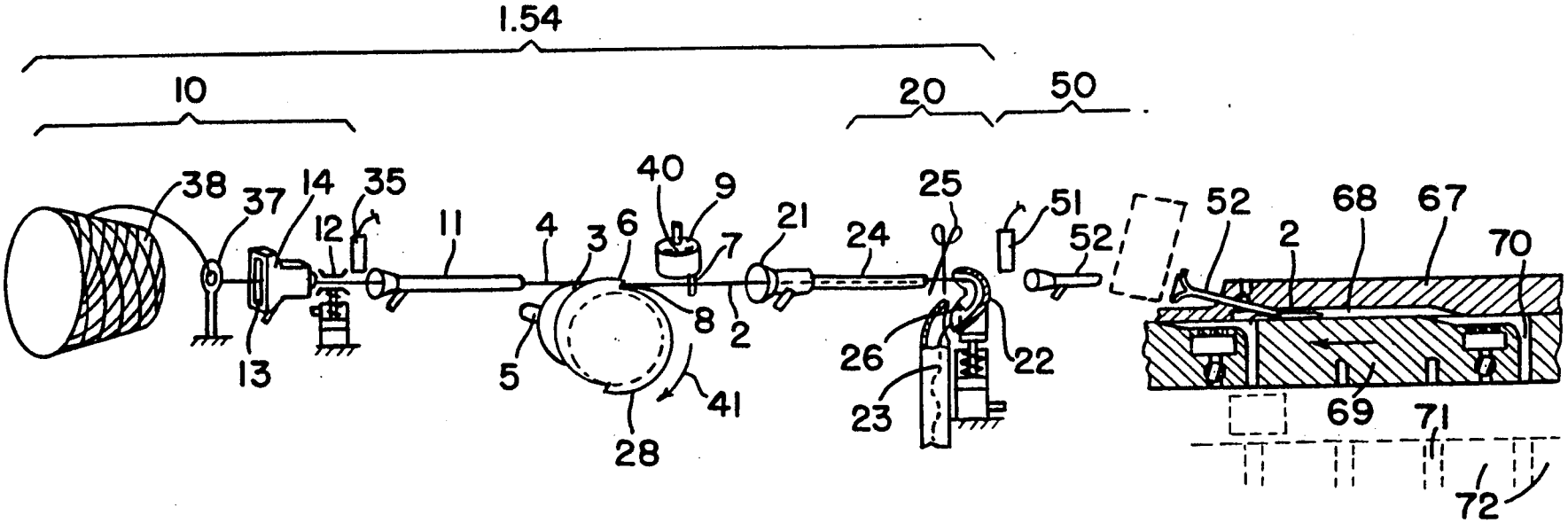

FIG. 10 schematically illustrates a control for programming the operation of a metering device in accordance with the invention; and FIG. 11 schematically illustrates the metering device of FIG. 1 with a weaving rotor.

Referring to FIG. 1, the metering device 1 for metering a weft yarn 2 in a loom includes a metering roller 3 having a spindle which is rotatably mounted on an axis 5 of rotation adjacent to and transverse to the yarn path 4 which extends between a supply unit 10 for supplying the weft yarn 2 and a draw off unit 20 for receiving the weft yarn 2. This metering roller 3 is positioned to carry a plurality of turns of the weft yarn 2 so as to determine the draw-off speed of the weft yarn 2 with the rotation of the roller 3 being adapted to the weaving cycle.

As illustrated in FIG. 1, a rotatably mounted catcher 6 having a catching zone 8 disposed radially outside the surface of the metering roller 3 is provided for selectively catching a yarn 2 in the yarn path 4 for subsequent looping of the yarn about the surface of the roller 3. As shown, the catcher 6 is integrally mounted on a radially protruding collar 28 of the roller 3. Also, a second catcher is disposed in diametric relation on the collar 28. In addition, a means is provided for selectively moving the yarn 2 in the yarn path 4 relative to the catcher 6 in order to effect catching of the yarn 2 in the catching zone 8 for wrapping about the surface of the roller 3. As illustrated, this means includes a deflector element 9 which is rotatably mounted on an axis transverse to the yarn path 4 and a pin 7 which is eccentrically mounted on the deflector element 9 for movement into the yarn path in response to rotation of the element 9 so as to move the yarn 2 into the catching zone 8. As indicated by the double arrow 40, the deflector element 9 may be oscillated about the axis of rotation.

The metering device also includes an injection nozzle 11 for receiving and directing a yarn from the supply unit along the yarn path 4 transverse to the axis 5 of the metering roller 3 and in spaced relation to the peripheral surface of the roller 3. Also, a catching nozzle 21 is disposed in the yarn path 4 downstream of the roller 3 for receiving the yarn 2 from the injection nozzle 11.

As illustrated in FIG. 1, the supply unit 10 includes a supply bobbin 38, a guide eye 37 for receiving and guiding the yarn delivered from the bobbin 38 and an extractor nozzle 14 having a slot-like entrance 13 for receiving the weft yarn for blowing into the yarn path 4. A brake 12 is disposed downstream of the extractor nozzle 14 and upstream of the injection nozzle 11 in order to brake the weft yarn from time-to-time. As illustrated, the injection nozzle 11 is disposed to receive and convey the weft yarn 2 from the extractor nozzle 14. In addition, a sensor 35 is disposed between the brake 12 and injection nozzle 11 for sensing the presence of the weft yarn 2.

The draw-off unit 20 includes a deflector 22 for selectively receiving a forward end of a yarn in the yarn path 4 and an accumulator 23 for receiving and accumulating a length of yarn deflected from the deflector 22 for subsequent release to permit wrapping of the yarn on the metering roller 3. In addition, the draw-off unit 20 includes a draw-off element 24 in the form of a tube in the yarn path between the metering roller 3 and the deflector 22 for adjustably tensioning the yarn in the picking direction. A severing element 25 is also located between the draw off element 24 and the deflector 22 for severing a yarn therebetween.

As illustrated, a conveying nozzle 52 of a yarn preparation means 50 is disposed downstream of the deflector 22 for conveying the weft yarn, for example, to a shed of a weaving loom. A sensor 51 is also disposed between the deflector 22 and the conveying nozzle 52 for sensing the presence of the yarn therebetween.

As indicated in FIG. 1, the deflector element 22 is of a pneumatic type so as to move into the path of the yarn in response to the sensing of a yarn break or at the time of introduction of a fresh weft yarn. In the illustrated position, the deflector 22 has been raised into the yarn deflecting position so that a yarn end 26 can be diverted into the accumulator 23.

The extractor nozzle 14 and injection nozzle 11 may be constructed so as to be pivotal into and out of the yarn path 4 so as to not interfere with the yarn picking operation when not required. Likewise, the severing element 25 and deflector 22 may be movable into and out of the path of the yarn for similar purposes.

During operation, the sensors located within the metering device respond to an interruption of the weft yarn, for example, sensors 35 and/or 51 respond to an interruption in the metering zone and output a signal to a control 33 (see FIG. 10) which stops the loom, clears yarn residues and brings the yarn 2 to a start position and also threads up a weft yarn 2 automatically to a starting position. The multiple turns of yarn on the roller 3 and the transfer of a yarn start to the picking preparation 50 are linked by the control 33 with the threading of the weft yarn 2.

In metering operation, the weft yarn 2 is drawn off the supply bobbin 38 and moves into the conveying direction through the guide 37, the suction extractor nozzle 14 and the brake 12, past the yarn interruption sensor 35 and through the injection nozzle 11 to the metering roller 3. After a number of wraps around the roller 3, the yarn 2 goes through the catching nozzle 21 and draw-off element 24, past the yarn interruption sensor 51 and into the conveying nozzle 52 of the picking preparation 50. The nozzles 14, 11 and severing element 25 and deflector 22 are not activated. The weft yarn 2 is braked with an adjustable force at the brake 12 and runs with prestressing onto the roller 3. The draw off element 24, i.e. nozzle, applies a tension to the weft yarn 2 such that the rope friction of the roller 3, which rotates in the wrapping direction indicated by the arrow 41, is sufficient to convey the yarn at a particular circumferential speed against the draw off reaction force and against the friction in the elements between the supply bobbin 38 and the metering roller 3. To prevent overwinding of the yarn departing from the roller 3, the generated surface of the roller 3 is a conical surface 32, as shown in FIG. 7, or is assisted, as in FIGS. 2, 4 to 6 and 8, 9 by a guide pin 30 disposed at an angle of less than 7° to the roller spindle on the axis of rotation 5.

The procedure for automated threading will first be described with reference to the arrangement shown in FIG. 1.

The yarn breakage signals output by the sensors 51, 35 are first assumed to indicate that the yarn 2 has broken in or after the brake 12 as considered in the direction of yarn movement. The pneumatic deflector 22 moves into the path of the yarn in front of the sensor 51. The yarn routes disposed after the brake 12 as considered in the direction of yarn movement are blown clear.

The metering roller 3, which is driven by a rotary motor 17 (see FIG. 4) combined with an angle encoder 16 (see FIG. 10) as a position detector rotates in the direction 41 indicated by the arrow until the catcher 6 on the metering roller collar 28 is nearest to the yarn path (injection axis) 4 in the start position. An injection instruction opens the brake 12 pneumatically and the nozzles 14, 11, 21 and draw-off element 24 are activated in each case for predetermined time intervals to shoot the yarn start originating from the breakage along the yarn path 4 from the nozzle 14 to the nozzle 11, past the generated surface of the roller 3 to the nozzle 21 and beyond by way of the draw off element 24 into the deflector 22. If, as previously assumed, there was still yarn in the suction nozzle 14, the sensor 35 now indicates the presence of yarn.

Figure 3:
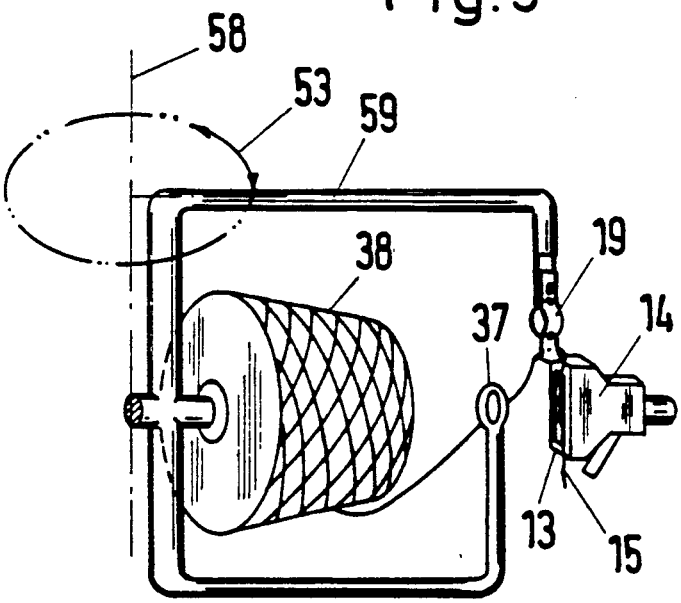
FIG. 3 illustrates a perspective view of a pivotally mounted supply bobbin having a yarn start prepared for transfer into a supply unit.

If the sensor 35 indicates no yarn at this time, it must be assumed that the yarn has run out and that the supply bobbin 38 needs changing. To this end, the injection instruction is first cancelled whereafter a pivoting mechanism 53 acts, as shown in FIG. 3, to pivot the old supply bobbin 38 around an axis 58 and to pivot a new supply bobbin 38 past a pivot arm 59 to the nozzle 14. The arm 59 extends laterally past the bobbin 38 in order to limit the draw off balloon and terminates at one end in a guide 37, through which the yarn start 15 of the new supply bobbin is guided, and at the other end, in a weak yarn clamp 19 which presents the overhanging yarn start 15 parallel to a slot 13 to the nozzle 14 for intake and further injection. Upon the completion of bobbin changing, the previously given injection instruction is reactivated and injection occurs, as previously described, as far as the deflector 22, the sensor 35 having to confirm the presence of yarn.

As indicated in FIG. 1, the yarn path 4 is disposed substantially in a plane perpendicular to the axis of rotation 5 of the metering roller 3 and at a very reduced distance from the generated surface of the roller 3, the latter distance being such that the airstream of the nozzle 11 is deflected only a little by the curvature of the generated surface.

In the deflector 32, the airstream and the weft yarn 26 are deflected to the yarn accumulator 23 unit. The brake 12 then closes while the catching nozzle 21 with the draw off element 24 continues to be supplied with air. There is no further conveyance of yarn since the braking force of the brake 12 is greater than the drawing off force of the element 24. The deflector element 9 near the catcher 6 now rotates through a predetermined angle and moves an edge of the pin 7 disposed transversely of the yarn path 4 into the same and deflects the weft yarn 2 further out with a controlled relative movement into the catching zone 8 of the catcher 6. The motor 17 (see FIG. 4) wraps a whole number of turns of weft yarn around the roller 3 in the direction indicated by the arrow 41 and at the start of each turn, the catcher 6 crosses the deflected weft yarn 2 in its catch zone 8 and entrains such yarn in the form of a loop. The weft yarn 2 is entrained by the catcher 6 against the pull applied by the draw off element 24, the yarn being drawn backwards off the accumulator 23 until the rope friction on the roller 3 is sufficient to draw the yarn off the bobbin 38 through the brake 12. Whenever the catcher 6 approaches the yarn path 4 during rotation with the drawn-on yarn loop, the yarn drawn onto the end face of the roller 3 from the nozzle 21 jumps back over the metering roller collar 28 onto the generated surface of the metering roller 3.

To ensure that the yarn jumps back in this way, a guide pin 30 as disposed in FIGS. 6 and 9 between the yarn path 4 and the roller 3 and the metering roller collar 28 has a covering 46 below which the guide pin 30 engages. The guide pin 30 of FIG. 9 also has an abutment 49 to prevent the weft yarn from the sliding off.

When the turns continue beyond the start position of the catcher 6, the weft yarn is recaught by the catcher 6 on each occasion until the deflector element 9 has been operated. The wrapping movements of the roller 3 are interrupted in the start position of the catcher 6 and the deflector element 9 pivots back into its initial position and releases the yarn moving to the catching nozzle 21. The weft yarn wraps around the roller 3 and stretches into the accumulator 23. Severance of the weft yarn by the severing element 25 disposed after the drawing off element 24 produces a new weft yarn tip whose position is defined by the position of the element 25. The severed yarn end disappears into the accumulator 23 and the deflector 22 returns to its initial position and opens the path to the conveying nozzle 52. By a controlled rotation of the roller 3 through a predetermined angle, the new weft yarn tip comes into a start position for the next weaving cycle, the presence of the weft yarn having to be confirmed by the sensor 51.

Figure 4:
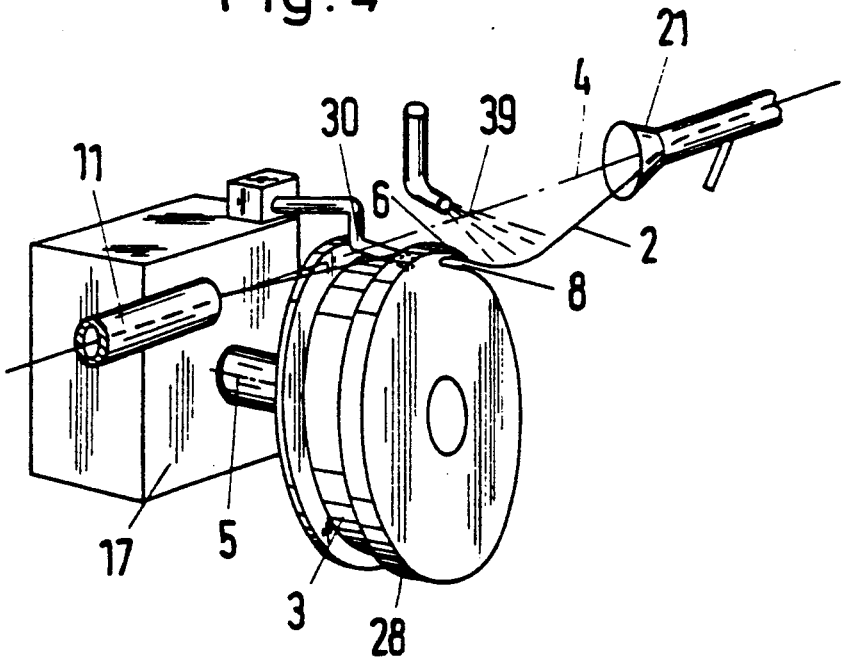
FIG. 4 illustrates a perspective view of the metering roller of FIG. 1 at a time of yarn catching via an air jet in accordance with the invention.

Referring to FIG. 4, wherein like reference characters indicate like parts as above, the means for effecting catching of the weft yarn 2 into the catcher 6 is in the form of an air jet nozzle for directing an airstream 39 to deflect the weft yarn 2 in the shape of an arc away from the yarn path 4 into the catching zone 8 of the catcher 6.

Figure 5:
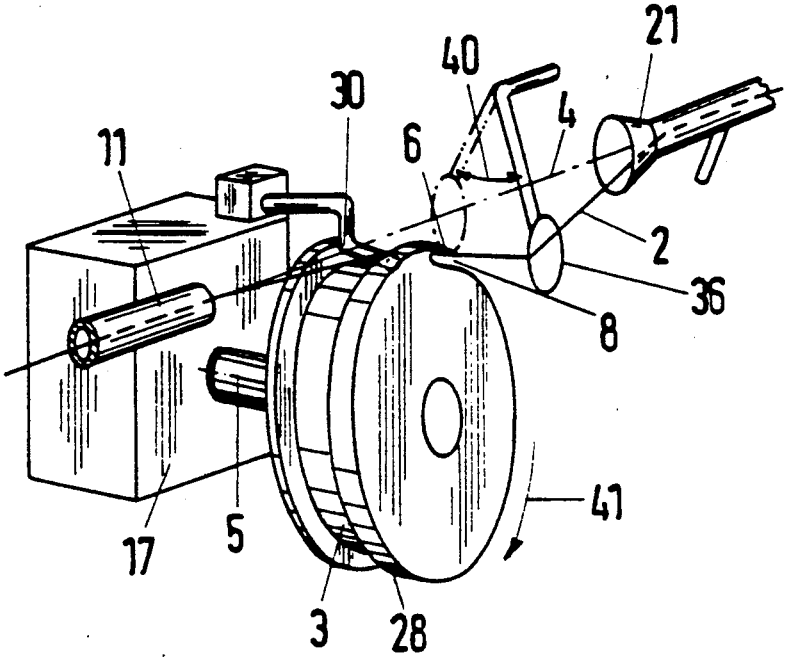
FIG. 5 illustrates a view similar to FIG. 4 at the time of yarn catching utilizing a pivotally mounted guide in accordance with the invention.
Figure 6:
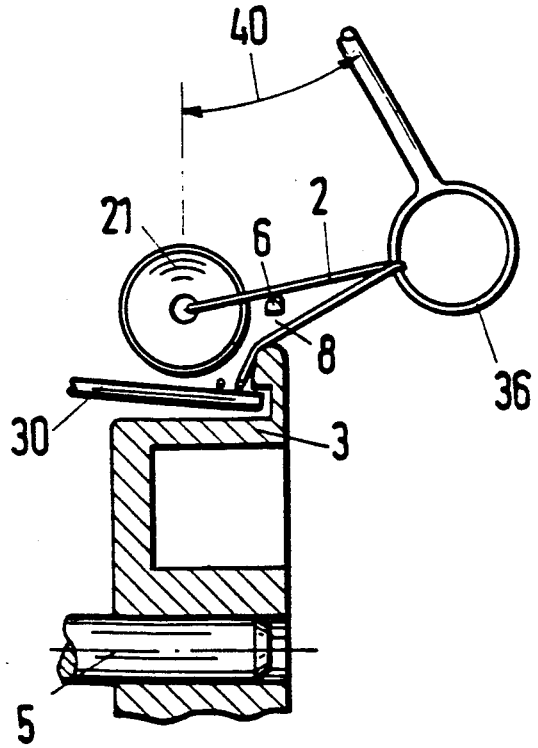
FIG. 6 illustrates a cross sectional view through a metering roller of FIG. 5 during yarn catching.
Figure 7:
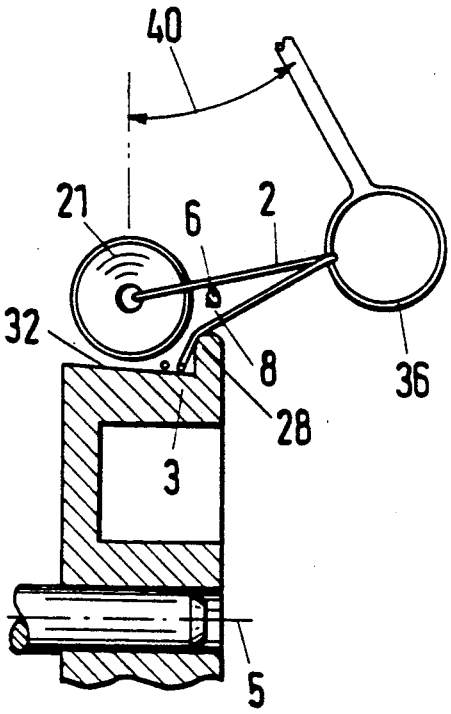
FIG. 7 illustrates a view similar to FIG. 6 of a modified metering roller having a conical peripheral surface.

Referring to FIGS. 5, 6, and 7, wherein like reference characters indicate like parts as above, the means for effecting catching of the weft yarn may be in the form of a pivoted guide 36 whose normal position is on the yarn path 4 so that the weft yarn is shot through the guide 36. When required, the guide 36 is able to pivot the weft yarn away from the yarn path 4 into the catching zone 8 of the catcher 6.

Figure 9:
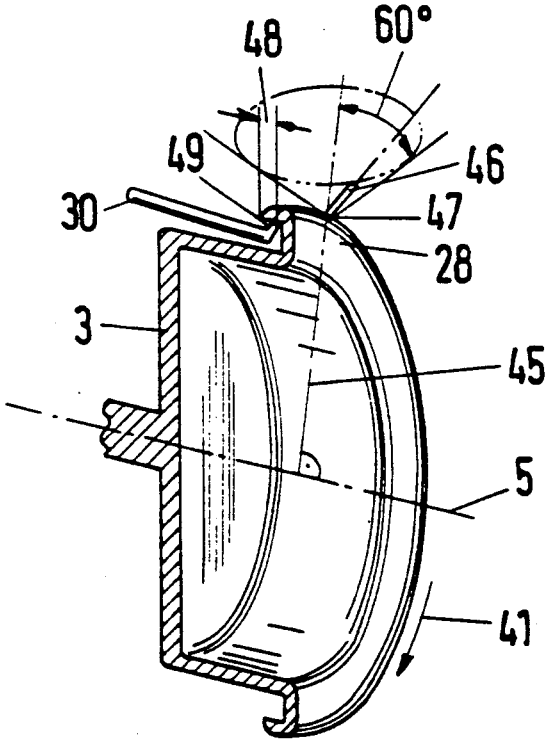
FIG. 9 illustrates a partial cross sectional view of a modified metering roller having a catching pin in accordance with the invention.

FIG. 9 shows a continuous collar 28 of the metering roller 3 with a pin 46 inserted in the collar 28 as a catcher 6. The pin axis forms an angle of less than 60° with the perpendicular from the root 47 of the pin 46 to the axis 5 of rotation of the roller 3. Some of the inclination of the pin 46 is in the wrapping direction 41 to ensure reliable takeover of the yarn. As compared with a catcher 6 in the form of a recess in the roller collar 28, the dynamic imbalance is less, the weight of the pin 46 can be determined more readily and it is a simple matter to compensate for the dynamic imbalance at high metering speeds.

Figure 2:
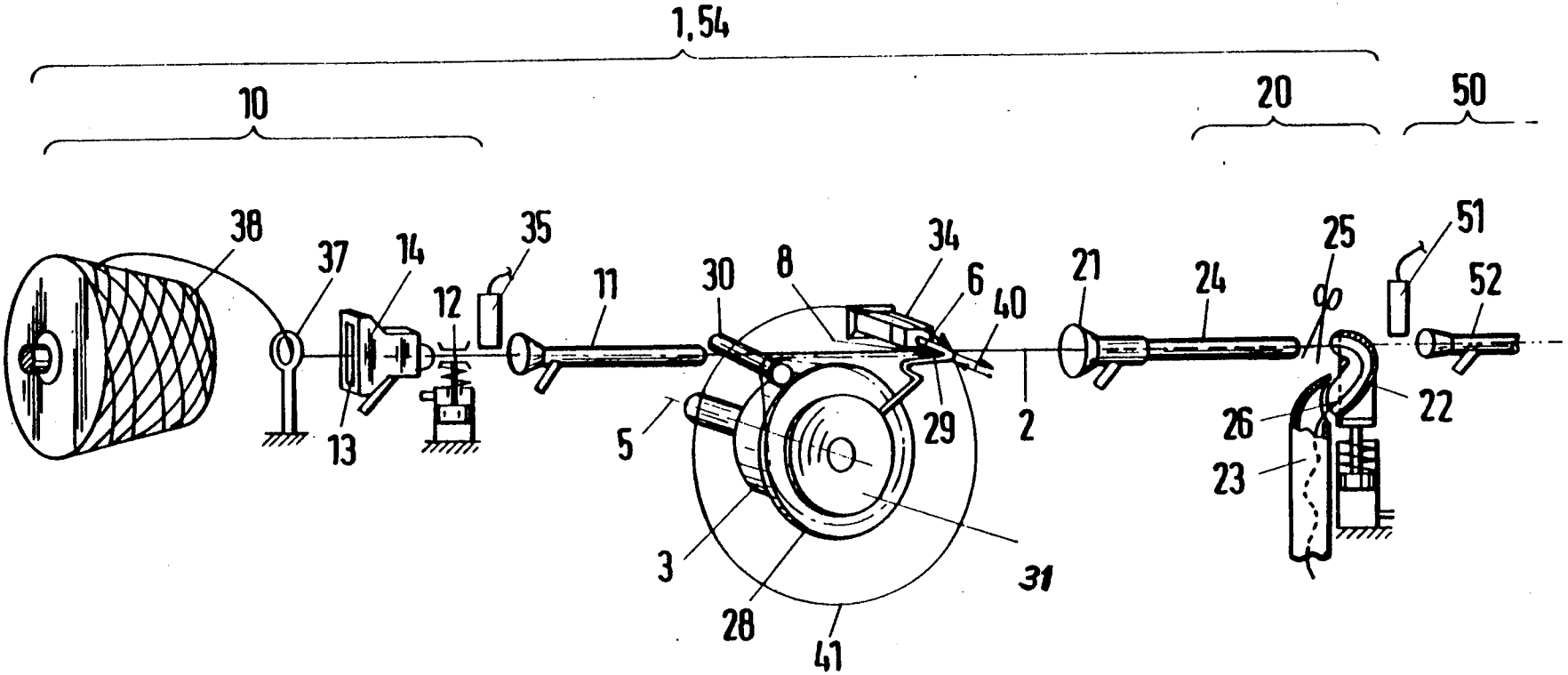
FIG. 2 illustrates a modified construction of a metering device between a supply unit and a draw off unit in accordance with the invention.

Referring to FIG. 2 wherein like reference characters indicate like parts as above, instead of moving the yarn 2 from the yarn path to the catcher 6, the catcher 6 may be moved relative to the yarn path. In this embodiment, the means for effecting the relative movement between the catcher 6 and the yarn 2 is in the form of a mounting 31 having the catcher 6 secured thereon with the catcher in the form of an open flier hook 29 having a plurality of bends. In this embodiment, the flier hook 29 is intermittently co-rotated with the metering roller 3 about the axis of rotation 5 of the roller.

Figure 8:
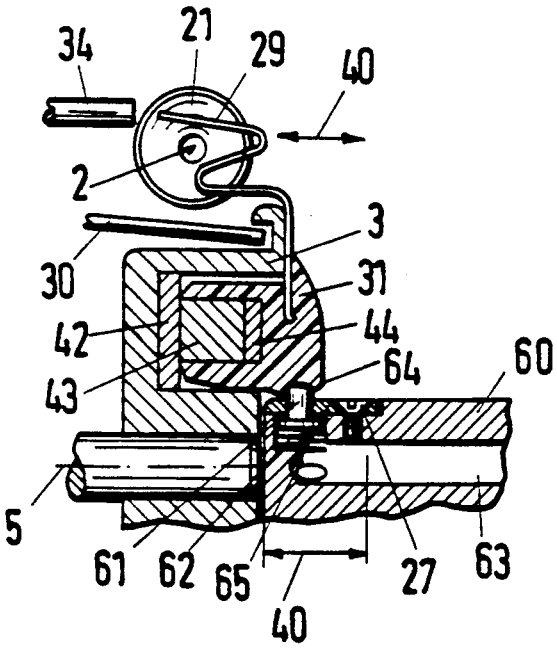
FIG. 8 illustrates a cross sectional view of a modified catcher and metering roller in accordance with the invention.

Referring to FIG. 8, wherein like reference characters indicate like parts as above, the mounting 31 has an annular stem portion for fitting within an annular recess of the roller 3 while having a head which is mounted toward the edge of the roller 3 to ensure a positive engagement. In addition, the mounting 31 is held in place magnetically. To this end, a soft iron ring 42 is provided within the roller 3 while permanent magnets 43 and pole bridges 44 are provided in the mounting 31. In this way, magnetic flux is bunched in the mounting 31.

Means is also provided for moving the mounting 31 coaxially of the roller 3 in the direction indicated by the arrow 40. In this respect, this means includes a transfer arm 60 which is reciprocably mounted coaxially of the roller 3 and mounting 31. The transfer arm 60 also carries three radially extending cylindrical cams 61 which are biased outwardly by springs 62 and which are also actuated by way of a compressed air connection 63 so as to selectively engage with and disengage from the mounting 31 in order to permit the transfer arm 60 to move away from the mounting 31.

In addition, the mounting 31 is provided with a retaining groove 64 to receive the cams 61. Further, the cams 61 are limited in the radially outwards movement by a bayonet fastening ring 65 which is secured to the transfer arm 60 by screws 27. Further, as indicated in FIG. 8, the receiving bore in the mounting 31 has a conical entry corresponding to the extended length of the cams 61.

When the mounting 31 moves into the roller 3, the cams are forced out by compressed air to be disposed in the retaining groove 64. When the magnets 43 secure the mounting 31 on the roller 3, the compressed air connection 63 is vented. The transfer arm 60 can then be drawn back in the mounting 31 and, during the disengaging movement, the cams 61 slide out of the groove 64 against the spring force and produce an axial force opposing the magnetic retaining forces. Such an axial force is greater than the force needed for entrainment during wrapping.

As shown in FIGS. 2 and 8, the sensor 34 is provided adjacent the yarn path and the hook 29 to sense the presence of the hook 29 during the withdrawal of the transfer arm 60. If the sensor 34 continues to indicate the presence of the hook 29 during the withdrawal of the transfer arm 60, the magnetic forces thus checked are deemed to be sufficient for wrapping.

After wrapping, the transfer arms 60 moves into the mounting 31. At this time, the cams 61 initially engage in the groove 64 only by virtue of the pressure of the springs 62. The cams 61 are then pressed tightly in the groove by compressed air through the connection 63 so that the mounting 31 can be withdrawn from the roller 3 against the magnetic forces, a step which is confirmed by the sensor 34.

When the mounting 31 is in place within the metering drum 3, the hook 29 is located above the yarn 2 (see FIG. 8). The sensor 34 monitors this initial position of the hook 29. Thereafter, as the hook 29 rotates about the axis of rotation 5 of the metering roller 3 along with the roller 3, the top arm of the hook 29 entrains the weft yarn 2 in a loop which, because of an inclination between the arm of the hook 29 and the axis of rotation 5, shifts with an increasing angle of rotation to the first bent of the Z-shaped arm towards the roller edge and which, within one complete rotation, changes to the inclined central arm of the hook 29 and therefrom to the generated surface of the roller 3. The yarn which has been drawn from the nozzle 11 runs on to the generated surface while the yarn drawn from the catcher nozzle 21 is drawn over the end face of the mounting 31 and roller 3 until jumping over the roller edge 28 on to the generated surface of roller 3. After one complete revolution, the hook 29 is again in its initial position, which is monitored by sensor 34, while the yarn, in the form of a loop from the nozzle 11, travels around the roller 3 and pin 30 and enters the catcher nozzle 21. The hook 29 covers the yarn moving from the roller 3 to the nozzle 21 so that the wrapping operation can be repeated. After a predetermined number of turns has been reached, the mounting 31 together with the hook 29 is withdrawn against the retaining forces of the permanent magnets 43 and axially of the axis of rotation 5 by an amount corresponding to the previous infeed movement 40 in order to ensure a safety distance relative to the roller 3 and to the moving yarn such that the roller 3 can subsequently provide a high-speed metering operation.

When not pushed on for operation, the mounting 31 is supported on the transfer arm 60 but when the mounting 31 is pushed on, the connection to the transfer arm 60 is interrupted so that the yarn can cross the metering roller end face during wrapping.

FIG. 10, wherein like reference characters indicate like parts as above, shows the hierarchy of the control 33 of a loom and indicates one possible way of incorporating the measuring devices 1 hereinbefore described in the control 33. A central control 55 co-ordinates the operational states and performance of various function groups 50, 54, 56, 57; the group 50 comprising elements for picking preparation, such as sensors and actuating elements; the group 54 comprising elements for operation and automatic threading of the metering device 1; the group 56 comprising the weaving elements; and the group 57 comprising fault-clearing elements.

Referring to FIG. 11, the metering device may be used in a loom which includes a weaving rotor (not shown) such as described in U.S. patent application Ser. No 07/609,892, filed Nov. 6, 1990 for forming a traversing shed. In this case, during normal weaving, the speed of the metering roller can be coupled in an adjustable ratio with the speed of the weaving rotor. As indicated, the nozzle 52 functions as a feeder nozzle which is mounted in a stationary part 67 of a distributor mechanism for blowing the filling thread 2 into a respective channel 68 of the stationary part 67. In addition, a rotatable part 69 has a plurality of picking tubes 70 disposed on a common picking circle for picking of the filling threads 2 into respective picking channels 71 of the weaving rotor 72.

The invention thus provides a metering device for the weft yarn in a loom in which weft yarn interruptions can be cleared automatically as they arise or as instructed by a loom operator. One advantage of the metering device resides in an increased loom availability, and, thus, a reduction in unwanted losses of weaving time.

The invention further provides a metering device which is able to provide automatic threading when supply bobbins are renewed or when there are weft yarn breakages. Further, the metering device allows a new weft yarn to be automatically programmed into a start position for weaving while being able to deliver a weft yarn to a loom in a coordinated fashion.

What is claimed is:

1. A metering device for metering a weft yarn in a loom, said device comprising a metering roller rotatably mounted on a first axis for disposition between a supply unit for supplying a weft yarn and a draw-off unit for receiving a weft yarn;

an injection nozzle for receiving and directing a yarn from the supply unit along a predetermined path transverse to said axis of said roller and spaced from a peripheral surface of said roller;

a catching nozzle in said path downstream of said roller for receiving a yarn from said injection nozzle;

a rotatably mounted catcher having a catching zone for selectively catching a yarn in said path for looping about said peripheral surface of said roller; an means for selectively moving one of said catcher and a yarn in said path relative to each other to effect catching of the yarn in said catching zone for wrapping about said surface of said roller.

2. A metering device as set forth in claim 1 wherein said means includes a deflector element rotatably mounted on a second axis transverse to said path and a pin eccentrically mounted on said element for movement into said path in response to rotation of said element about said second axis to move a yarn in said path into said catching zone.

3. A metering device as set forth in claim 1 wherein said means is an air jet nozzle for deflecting a yarn in said path into said catching zone.

4. A metering device as set forth in claim 1 wherein said means is a pivotally mounted guide movable between a first position in said path with a yarn passing therethrough and a second position to deflect a yarn in said path into said catching zone.

5. A metering device as set forth in claim 1 wherein said means includes a mounting having said catcher secured thereon and disposed coaxially of said metering roller and second means for moving said mounting coaxially of said roller.

6. A metering device as set forth in claim 5 wherein said second means includes a transfer arm reciprocably mounted coaxially of said roller and said mounting and means on said transfer arm for selectively engaging with and disengaging from said mounting to permit said arm to move away from said mounting.

7. A metering device as set forth in claim 5 wherein said catcher is an open flier hook having a plurality of bends.

8. A metering device as set forth in claim 1 wherein said catcher is integrally mounted on a radially protruding collar of said roller and said catching zone is disposed radially outside said peripheral surface of said roller.

9. A metering device as set forth in claim 1 wherein said catcher is a pin having a pin axis defining an angle of less than 60° with a perpendicular line from a root of said pin to said first axis.

10. A metering device as set forth in claim 1 wherein said surface of said metering roller is conical and tapers inwardly in a direction towards said catcher.

11. A metering device as set forth in claim 1 wherein said metering roller has an upraised edge on one side and a lip extending from said edge over said peripheral surface and which further comprises a guide pin between said path and said metering roller and projecting between said lip and said peripheral surface.

12. A metering device as set forth in claim 11 wherein said guide pin has an abutment at one end between said lip and said peripheral surface of said roller to prevent sliding off of a yarn from said pin.

13. A metering device for metering a weft yarn in a loom, said device comprising a metering roller rotatably mounted on a first axis for disposition adjacent and transverse to a yarn path between a supply unit for supplying a weft yarn and a draw off unit for receiving a weft yarn, said roller having a peripheral surface for receiving loops of a weft yarn thereon;

a rotatably mounted catcher having a catching zone disposed radially outside said surface of said roller for selectively catching a yarn in said path and looping the yarn about said surface; and means for selectively moving one of said catcher and a yarn in said path relative to each other to effect catching of the yarn in said catching zone for wrapping about said surface of said roller.

14. A metering device a set forth in claim 13 wherein said catcher is integrally mounted on a radially protruding collar of said roller.

15. A metering device as set forth in claim 13 wherein said catcher is a pin having a pin axis defining an angle of less than 60° with a perpendicular line from a root of said pin to said first axis.

16. A metering device as set forth in claim 13 wherein said metering roller has an upraised edge on one side and a lip extending from said edge over said peripheral surface and which further comprises a guide pin between said path and said metering roller and projecting between said lip and said peripheral surface.

17. In a loom, the combination comprising a supply unit for supplying a weft yarn along a predetermined path;

a draw off unit for receiving a weft yarn in said path; and a metering device between said units, said metering device including a metering roller rotatably mounted on a first axis transverse to said path and having a peripheral surface spaced from said path, a rotatably mounted catcher having a catching zone for selectively catching a yarn in said path for looping about said roller surface and means for selectively moving one of said catcher and a yarn in said path relative to each other to effect catching of the yarn in said catching zone for wrapping about said surface of said roller.

18. The combination as set forth in claim 17 wherein said draw off unit includes a deflector for selectively receiving a forward end of a yarn in said path and an accumulator for receiving and accumulating a length of yarn from said deflector for subsequent release to permit wrapping of the yarn on said roller.

19. The combination as set forth in claim 18 wherein said draw off unit includes a draw off element in said path between said roller and said deflector for adjustably tensioning a yarn in a picking direction.

20. The combination as set forth in claim 19 wherein said draw off unit includes a severing element between said draw off element and said deflector for severing a yarn therebetween.

21. The combination as set forth in claim 17 wherein said supply unit includes a brake for braking a yarn in said path during wrapping of the yarn on said metering roller.

22. The combination as set forth in claim 17 wherein said supply unit includes an extractor nozzle having a slot-like entrance for receiving a weft yarn for blowing into said path and an injection nozzle in said path to receive and convey a weft yarn from said extractor nozzle.

23. The combination as set forth in claim 17 further comprising a plurality of sensors along said path for sensing the presence of a yarn therein and a control connected with said sensors, said units and said metering device for actuating said units and said metering device in response to signals from said sensors to effect a predetermined wrapping of a yarn on said metering roller.

24. The combination as set forth in claim 17 which further comprises a weaving rotor for forming a traversing shed, said metering roller being coupled to said weaving rotor in an adjustable ratio.

* * * * *